US009850640B2

(12) United States Patent
Lyle et al.

(10) Patent No.: US 9,850,640 B2
(45) Date of Patent: Dec. 26, 2017

(54) WORKING MACHINE

(71) Applicant: J. C. Bamford Excavators Limited, Uttoxeter, Staffordshire (GB)

(72) Inventors: Jonathan Lyle, Uttoxeter (GB); John Griffin, Uttoxeter (GB); Peter Jowett, Uttoxeter (GB)

(73) Assignee: J. C. Bamford Excavators Limited, Uttoxeter, Staffordshire (GB)

( * ) Notice: Subject to any disclaimer, the term of this patent is extended or adjusted under 35 U.S.C. 154(b) by 15 days.

(21) Appl. No.: 14/927,370

(22) Filed: Oct. 29, 2015

(65) Prior Publication Data

US 2016/0122971 A1 May 5, 2016

(30) Foreign Application Priority Data

Oct. 29, 2014 (GB) ..... 1419273.6

(51) Int. Cl.
*E02F 3/32* (2006.01)
*E02F 9/08* (2006.01)
(Continued)

(52) U.S. Cl.
CPC ..... *E02F 9/08* (2013.01); *E02F 3/325* (2013.01); *E02F 9/02* (2013.01); *E02F 9/085* (2013.01);
(Continued)

(58) Field of Classification Search
CPC ..... E02F 3/327; E02F 9/085; E02F 9/166
(Continued)

(56) References Cited

U.S. PATENT DOCUMENTS

2003/0226293 A1 12/2003 Takemura et al.
2005/0034336 A1 2/2005 Takemura et al.
(Continued)

FOREIGN PATENT DOCUMENTS

EP 1 507 043 A2 2/2005
EP 1997964 A2 12/2008
(Continued)

OTHER PUBLICATIONS

Search Report for GB 1419273.6, dated Mar. 13, 2015.
Extended European Search Report for European Patent Application No. 15 19 2193, dated Apr. 4, 2016.

*Primary Examiner* — Gerald McClain
*Assistant Examiner* — Ronald Jarrett
(74) *Attorney, Agent, or Firm* — Marshall, Gerstein & Borun LLP

(57) ABSTRACT

A working machine comprising a ground engaging structure and an undercarriage connected to the ground engaging structure. A superstructure is rotatably mounted to the undercarriage so as to be rotatable relative to the undercarriage about a first generally upright axis, an operator's cab is rotatably mounted on the superstructure so as to be rotatable relative to the superstructure about a second generally upright axis, and a working arm is rotatably mounted to the superstructure so as to be moveable up and down about a generally horizontal axis. A drive arrangement is provided for driving the ground engaging structure to propel the working machine. The drive arrangement includes an engine and transmission that are housed within the undercarriage, and a majority of the engine is positioned below a level coincident with a lower extent of the superstructure.

20 Claims, 11 Drawing Sheets

(51) Int. Cl.
*E02F 9/02* (2006.01)
*E02F 9/16* (2006.01)
*E02F 9/18* (2006.01)

(52) U.S. Cl.
CPC ..... *E02F 9/0866* (2013.01); *E02F 9/0883* (2013.01); *E02F 9/166* (2013.01); *E02F 9/18* (2013.01)

(58) Field of Classification Search
USPC ..... 414/687
See application file for complete search history.

(56) References Cited

U.S. PATENT DOCUMENTS

| | | | | |
|---|---|---|---|---|
| 2008/0292442 | A1* | 11/2008 | McKee | B62D 33/0617 414/694 |
| 2009/0066046 | A1 | 3/2009 | Takemura et al. | |
| 2009/0133950 | A1* | 5/2009 | Takemura | B60K 5/00 180/305 |
| 2013/0093214 | A1* | 4/2013 | Ushiroguchi | E02F 9/0816 296/193.01 |
| 2013/0149095 | A1 | 6/2013 | Huissoon | |
| 2013/0199463 | A1* | 8/2013 | Pischinger | B60L 11/126 123/2 |

FOREIGN PATENT DOCUMENTS

| | | |
|---|---|---|
| GB | 1 529 247 A | 10/1978 |
| GB | 2 257 414 A | 1/1993 |

* cited by examiner

WORKING MACHINE

FIELD OF THE INVENTION

The present invention relates to a working machine.

BACKGROUND OF THE INVENTION

Various types of working machines are known. Such machines are used typically for soil-shifting operations (e.g. trenching, grading, and loading) and materials handling (e.g. depositing aggregate in trenches, lifting materials and placing them on an elevated platform).

Such machines are typically manufactured from a set of subassemblies designed specifically for one type of machine, although certain components such as engines, gearboxes, and hydraulic pumps may be shared across different machine types.

Examples of known machines include the following:

Slew excavators comprise a superstructure rotatable in an unlimited fashion relative to an undercarriage. The superstructure includes a working arm arrangement for manipulating an attachment, such as a bucket, to perform working operations of the type listed above, a prime mover, such as a diesel IC engine, a hydraulic pump, and an operator cab. The prime mover drives the hydraulic pump, in order to provide pressurized fluid to operate the working arm arrangement, and also to power one or more hydraulic motors located in the undercarriage that are used to selectively drive either two endless tracks or four wheels (or eight wheels in a dual wheel configuration) for propelling the excavator.

A slew ring rotatably connects the superstructure and undercarriage, and a central rotary joint arrangement enables hydraulic fluid to pass from the pump in the superstructure to the hydraulic motor, and return to the superstructure, irrespective of the relative positions of the superstructure and undercarriage. If the slew excavator uses tracks for propulsion, steering is effected by differentially driving the tracks on opposing sides of the undercarriage. If the slew excavator uses wheels for propulsion, a steering arrangement is used for either two or four wheels, and separate hydraulic control is required for this in the undercarriage.

Slew excavators are available in a wide range of sizes. Micro, mini and midi excavators span an operating weight range from around 750 kg up to around 12,000 kg and are notable for typically having a working arm arrangement that is capable of pivoting about a substantially vertical axis relative to the superstructure by using a "kingpost" interface to the superstructure. Generally, mini and midi excavators have a weight of above around 1,200 kg. Large excavators, whose operating weight exceeds around 12,000 kg are often referred to as 'A frame' excavators and typically have a working arm arrangement that is fixed about a vertical axis, and can therefore only slew together with the superstructure. This is a function of the fact that the smaller excavators are expected to operate in more confined spaces and the ability to slew about two mutually offset axes in order to, for example, trench close to an obstacle such as a wall is therefore more desirable for micro, mini and midi excavators.

The working arm arrangement generally includes a boom pivotally connected to a dipper. There are several types of booms available including: a triple articulated boom which has two pivotally connected sections; and a mono boom that is often made from a single generally curved structure. A dipper is pivotally connected to the boom and a mount for an attachment, e.g. a bucket, is provided on the dipper. Hydraulic cylinders are provided to move the boom, dipper and mount relative to each other so as to perform a desired working operation.

Tracked excavators are not able to travel under their own propulsion for significant distances due to a low maximum speed and the damage their metal tracks cause to paved roads. However their tracks enhance the stability of the excavator. Wheeled excavators are capable of "roading" at higher speeds (typically up to 40 kph), and without appreciably damaging paved road surfaces. However, the working arm assembly inevitably extends forward of the superstructure during roading, which can impair ride quality, and forward visibility. When performing working operations the pneumatic tires provide a less stable platform than tracks, so additional stabilizer legs can be deployed for stability.

Since the prime mover, hydraulic pump, hydraulic reservoir etc. are located in the superstructure, the center of gravity of all types of slew excavator is relatively high. Whilst these components can be positioned to act as a counterbalance to forces induced during working operations, packaging constraints may force such positioning to be sub-optimal, and may also restrict sight-lines over the rear of the machine, for example.

Excavators are generally used for operations such as digging. However, if it is desired to perform an operation such as loading, an alternative type of machine must be used. Machines capable of loading operations are known and have various formats. In one format, commonly referred to as a "telescopic handler" or "telehandler", the superstructure and undercarriage are fixed relative to each other and a central working arm in the form of a two or more part telescopic boom extends fore-aft of the machine. The boom pivots about a horizontal axis towards the aft end of the machine, an attachment is releasably mounted to a fore end of the boom, and is pivotable about a second distinct horizontal axis. Commonly used attachments include pallet forks and shovels. Telehandlers may be used for general loading operations (e.g. transferring aggregate from a storage pile to a required location on a construction site) and lifting operations, such as lifting building materials on to an elevated platform.

Telehandlers typically have four wheels on two axles for propulsion, with one or both axles being steerable and driven. A prime mover (typically a diesel IC engine) may be located in a pod offset to one side of the machine between front and rear wheels and is connected to the wheels by a hydrostatic or mechanical transmission. An operator cab is often located on the other side of the boom to the prime mover, and is relatively low between the wheels. Depending upon its intended application, the machine may be provided with deployable stabilizer legs.

A subset of telehanders mount the cab and boom on a rotatable superstructure in order to combine lifting with slewing operations, at the expense of additional weight and greater height. As these machines are used principally for lifting, instead of loading, they have a longer wheelbase than conventional telehandlers to accommodate a longer boom, impacting maneuverability. Further, as sight-lines towards the ground close to the machine are less critical for lifting than for excavating, these are consequently quite poor.

It is further desirable that working machines become more efficient in operation, in terms of the amount of working operations undertaken for a given amount of fuel used. This may be a function of the fuel efficiency of the prime mover, transmission, driveline and hydraulic system, as well as being due to secondary factors such as poor visibility meaning that an operator needs to reposition the working machine unnecessarily frequently so as to view the working operation, or carrying out an operation much more slowly thereby compromising efficiency.

SUMMARY OF THE INVENTION

The present invention aims to alleviate one or more of the problems associated with working machines of the prior art.

A first aspect of the invention provides a working machine comprising a ground engaging structure; an undercarriage connected to the ground engaging structure; a superstructure rotatably mounted to the undercarriage so as to be rotatable relative to the undercarriage about a first generally upright axis; an operator's cab rotatably mounted on the superstructure so as to be rotatable relative to the superstructure about a second generally upright axis; a working arm rotatably mounted to the superstructure so as to be moveable up and down about a generally horizontal axis; and a drive arrangement for moving the ground engaging structure to propel the working machine, the drive arrangement including a prime mover and transmission; and wherein the prime mover and transmission are housed within the undercarriage, and the prime mover is positioned below a level coincident with a lower extent of the superstructure.

Advantageously, the cab and superstructure of the present invention can be rotated relative to each other for optimized working in confined working spaces and improved visibility. For example, when the working machine is driven on the road, the cab and superstructure can be rotated relative to each other so as to position the working arm to the rear of the working machine to give an operator an improved view of the road ahead.

Visibility is further improved by housing the prime mover and transmission within the undercarriage and positioning the majority of the prime mover below a level coincident with an upper extent of the wheels. Often in conventional working machines the prime mover is housed in the superstructure, but this creates a barrier to sight for an operator of the working machine. Moving the prime mover to a lower position on the working machine moves the or part of the prime mover away from the line of sight of an operator. The working arm may comprise a mount for mounting an attachment, e.g. a bucket.

In one embodiment, the working arm is rotatably mounted to the superstructure so as to be rotatable relative to the superstructure about a third generally upright axis.

Provision of a working arm rotatable relative to the superstructure about a third generally upright axis advantageously further improves the versatility of the working machine, and the visibility for a user during a wide range of operations. For example, when the machine is excavating near a barrier, e.g. a wall, the cab, superstructure and working arm can be rotated relative to each other such that the working arm is to the front of the machine but offset to one side, permitting digging close to the wall and the cab can be rotated towards the region to be dug to improve visibility of the excavating operation In one embodiment, the ground engaging structure includes a front and rear axle each having a pair of wheels mounted thereto.

In one embodiment, a majority of the prime mover is positioned below a level coincident with an upper extent of the wheels.

In one embodiment, the prime mover is positioned between the front and rear axles.

Such positioning advantageously further improves visibility of an operator and the compactness of the working machine.

In one embodiment, the prime mover is mounted in a transverse direction to a fore-aft direction of the working machine.

In one embodiment, the prime mover is mounted substantially perpendicular to the fore-aft direction of the working machine. The prime mover may be an engine, for example a reciprocating engine e.g. a diesel IC engine.

In one embodiment, the prime mover is a reciprocating engine including pistons and the engine is mounted such that the pistons have an upright orientation.

In one embodiment, a heat exchanger and cooling fan are mounted adjacent the prime mover and arranged such that an axis of rotation of the fan is substantially parallel to a fore-aft direction of the working machine.

In one embodiment, the working machine comprises a fuel tank positioned on one side of an axis extending in the fore-aft direction of the working machine and the prime mover is positioned on the other side of an axis extending in the fore-aft direction of the working machine.

In one embodiment, the working machine comprises a hydraulic fluid tank positioned on one side of an axis extending in a fore-aft direction of the working machine and the engine is positioned on the other side of the axis extending in the fore-aft direction of the working machine.

In one embodiment, the cab is positioned substantially centrally to the superstructure.

In one embodiment, the second upright axis about which the superstructure is rotated is substantially central to the undercarriage.

In one embodiment, a counter weight is mounted to the superstructure in a position opposite the working arm.

In one embodiment, the counter weight is curved and a portion of the cab is curved, and wherein the curve of the counter weight follows the curve of the cab.

Such a configuration is advantageous for providing a more compact superstructure. For example, a front and a rear of the cab may be curved.

In one embodiment, the working arm has a boom and a dipper pivotally connected to the boom.

In one embodiment, one or more hydraulic cylinders are configured to pivot the dipper relative to the boom.

Advantageously the boom may comprise at least two sections pivotally connected (e.g. the boom is a triple articulated boom). One or more hydraulic cylinders may be configured to rotate one section of the boom relative to another section of the boom.

In one embodiment, the working machine weighs between about 1200 kg and 12000 kg. For example, the working machine may be a mini or a midi excavator.

In one embodiment, the working arm is mounted to the superstructure using a kingpost arrangement.

In one embodiment, a hydraulic cylinder is used to rotate the working arm relative to the superstructure about the third generally upright axis.

In one embodiment, the transmission comprises a hydraulic pump and a hydraulic motor.

In one embodiment, the hydraulic pump supplies fluid to the hydraulic cylinder to actuate rotation of the working arm.

In one embodiment, the hydraulic pump supplies fluid to the one or more hydraulic cylinders to rotate the dipper relative to the boom.

In one embodiment, the superstructure is dimensioned to be longer in length than width, the length and width being defined such that when the working machine is driving along a road the length of the superstructure is in a fore-aft direction.

In one embodiment, the working arm is mounted to the superstructure at a position that is at one end of the superstructure in a length direction and central to the superstructure in a width direction. The undercarriage may be longer in a fore-aft direction than the superstructure.

In one embodiment, the superstructure can rotate relative to the undercarriage by at least 180°.

In one embodiment, the cab can rotate relative to the superstructure by at least 180°.

In one embodiment, the superstructure is rotatable relative to the undercarriage and/or the cab is rotatable relative to the superstructure using an electric motor.

In one embodiment, the superstructure is rotatable relative to the undercarriage and/or the cab is rotatable relative to the superstructure using the hydraulic motor.

In one embodiment, the rotary connection between the superstructure and the undercarriage includes a rotary joint arrangement configured to permit electrical signals and/or hydraulic fluid to be routed to the superstructure independently of the position of the superstructure relative to the undercarriage.

In one embodiment, the rotary connection between the superstructure and the cab includes a mechanism for routing hoses and/or cables from the superstructure to the cab, the mechanism being configured to permit hoses and/or cables to be wound or unwound to account for the position of the cab relative to the superstructure.

In one embodiment, the working machine is configured for four wheel drive.

In one embodiment, the front and rear axles are configured for at least two wheel steer. For example, the front and rear axles may be configured for two or four wheel steer.

The cab may have a width of between one third and two thirds of the distance between an outboard side of each of the wheels of the pair of wheels mounted to the front axle. The cab may have a width of between one third and one half of the distance between an outboard side of each of the wheels of the pair of wheels mounted to the front axle. The superstructure may have a width substantially equal to or less than the width of the undercarriage. The superstructure may have a length substantially equal to one half to three quarters of the length of the undercarriage.

In one embodiment, the line of sight angle over the right hand rear corner of the machine for an operator having a height of 185 cm is at least 30° below the horizontal, more preferably at least 45° below the horizontal.

In one embodiment, the working machine is at least a compact tail swing excavator, preferably wherein the working machine is a zero tail swing excavator.

In one embodiment, the axis of rotation of the cab with respect to the superstructure is coincident with the axis of rotation of the superstructure with respect to the undercarriage.

In one embodiment, the axis of rotation of the cab with respect to the superstructure is offset from the axis of ration of the superstructure with respect to the undercarriage.

In one embodiment, the working machine comprises stabilizing feet that are extendable to engage with the ground.

In one embodiment, the working machine comprises a dozer blade.

BRIEF DESCRIPTION OF THE DRAWINGS

Embodiments of the invention will now be described with reference to the accompanying drawings, in which.

DETAILED DESCRIPTION OF EMBODIMENT(S)

General Format

Figure 1:
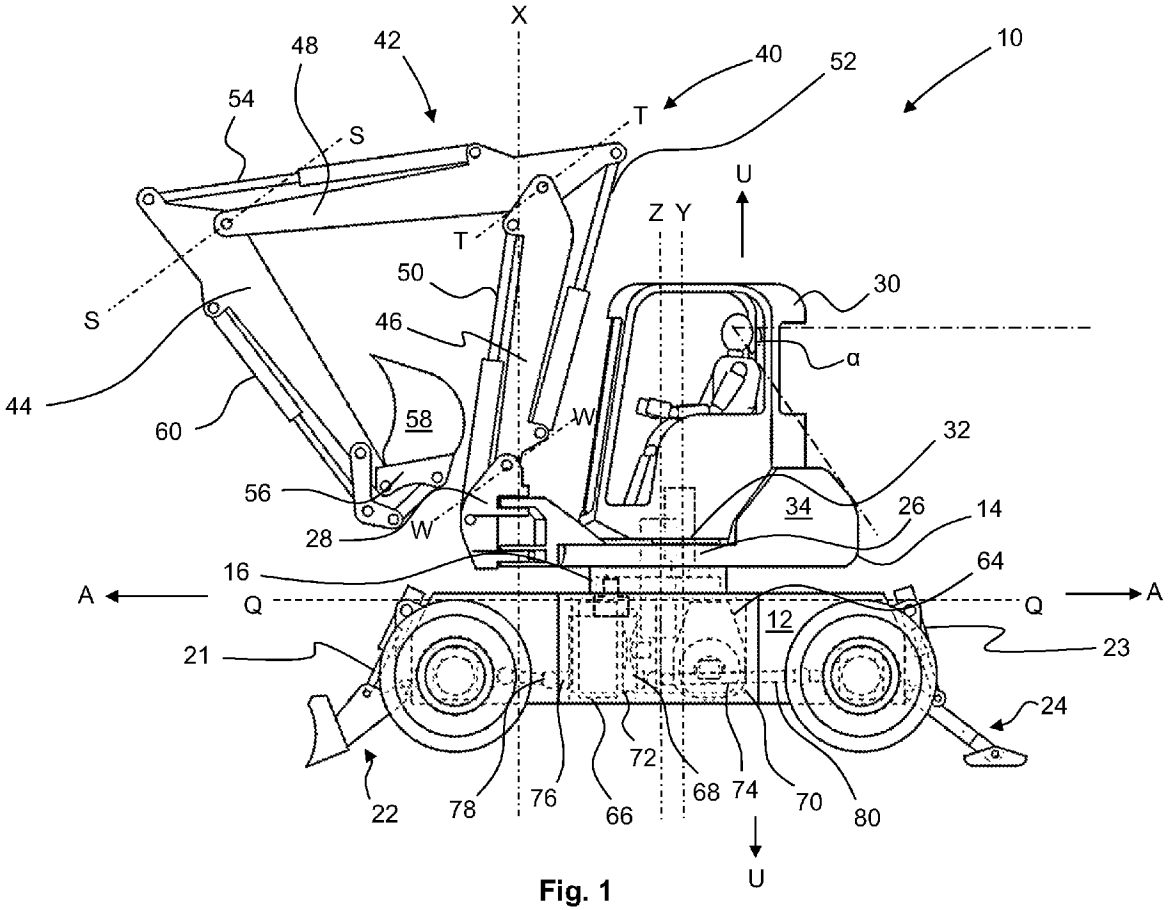
FIG. 1 is a side view of a working machine according to an embodiment of the present invention in a straight dig position.
Figure 2:
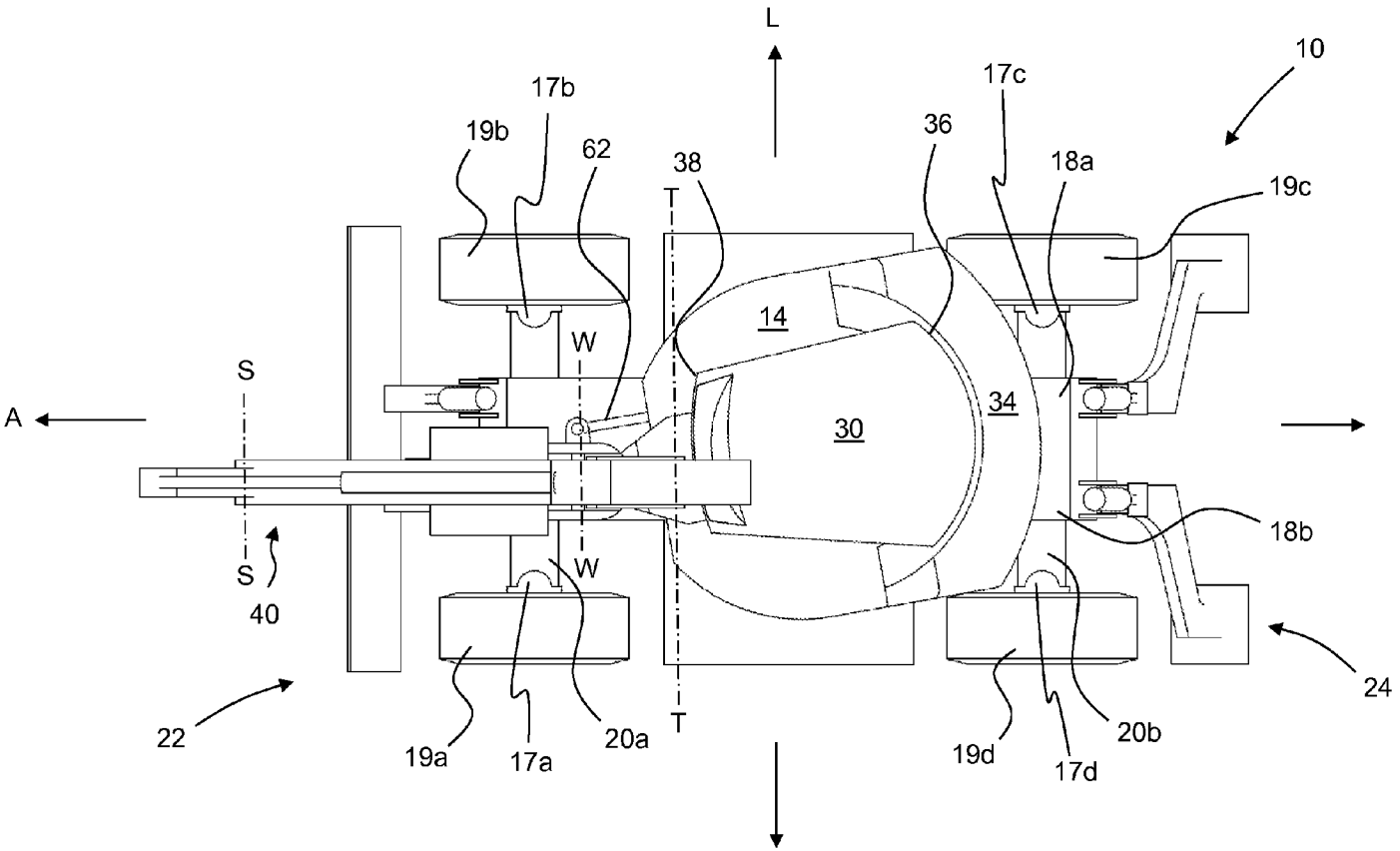
FIG. 2 is a plan view of the machine of FIG. 1.
Figure 3:
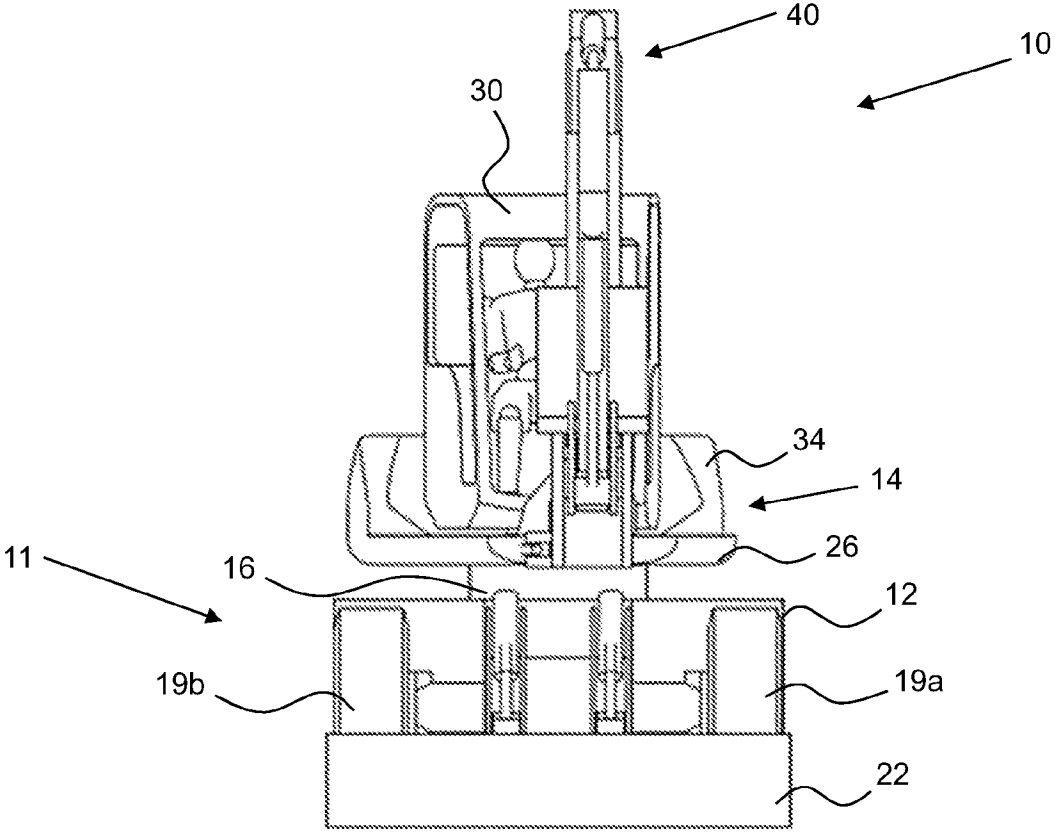
FIG. 3 is a front view of the machine of FIG. 1.

With reference to FIGS. 1 to 3, there is illustrated in somewhat simplified form a working machine 10 according to an embodiment of the present invention. In the present embodiment, the working machine may be considered to be a midi excavator (operating weight between approx. 6 and 12 metric tons). In other embodiments the working machine may be a mini excavator (operating weight between 1.2 and 6 tons). The machine comprises an undercarriage 12 and a superstructure 14 linked by a slewing mechanism in the form of a slewing ring 16. The slewing ring 16 permits unrestricted rotation of the superstructure relative to the undercarriage 12 in this embodiment. A cab 30 from which an operator can operate the working machine is rotatably mounted to the superstructure. A working arm arrangement 40 is also rotatably mounted to the superstructure and provided for performing material handling operations.

Undercarriage

The undercarriage is formed from a pair of spaced parallel chassis rails 18*a* and 18*b* extending fore-aft. The rails provide a majority of the strength of the undercarriage 12. The undercarriage is connected to a ground engaging structure, which in this embodiment includes first and second drive axles 20*a* and 20*b* are mounted to the chassis rails 18*a*, 18*b* and wheels rotatably attached to each axle end. In this embodiment the second drive axle 20*b* is fixed with respect to the chassis rails 18*a*, 18*b*, whereas the first drive axle 20*a* is capable of limited articulation, thereby permitting the wheels to remain in ground contact, even if the ground is uneven. The wheels 19*a*, 19*b*, 19*c*, 19*d*, are typically provided with off-road pneumatic tires. The wheels connected to both axles 20*a*, 20*b* are steerable via a steering hub 17*a*, 17*b*, 17*c*, 17*d*. In this embodiment, the wheelbase is 2.65 m, and a typical range is 2.0 m to 3.5 m.

For the purposes of the present application, the fore-aft direction A is defined as a direction substantially parallel to the general direction of the chassis rails 18*a* and 18*b*. A generally upright direction U is defined as a direction substantially vertical when the working machine is on level ground. A generally lateral direction L is defined as a direction that is substantially horizontal when the working machine is on level ground and is substantially perpendicular to the fore-aft direction A.

In this embodiment a dozer blade arrangement 22 is pivotally secured to one end of the chassis rails 18*a* and 18*b*, which may be raised and lowered by hydraulic cylinders 21 using a known arrangement, and also act as a stabilizer for the machine, by lifting the adjacent wheels off the ground when excavating, however this may not be provided in other embodiments.

A stabilizer leg arrangement 24 is pivotally mounted to an opposite end of the chassis rails 18*a* and 18*b*, which also may be raised and lowered by hydraulic cylinders 23 using a known arrangement, but in other embodiments this may be omitted.

Drive

Figure 4:
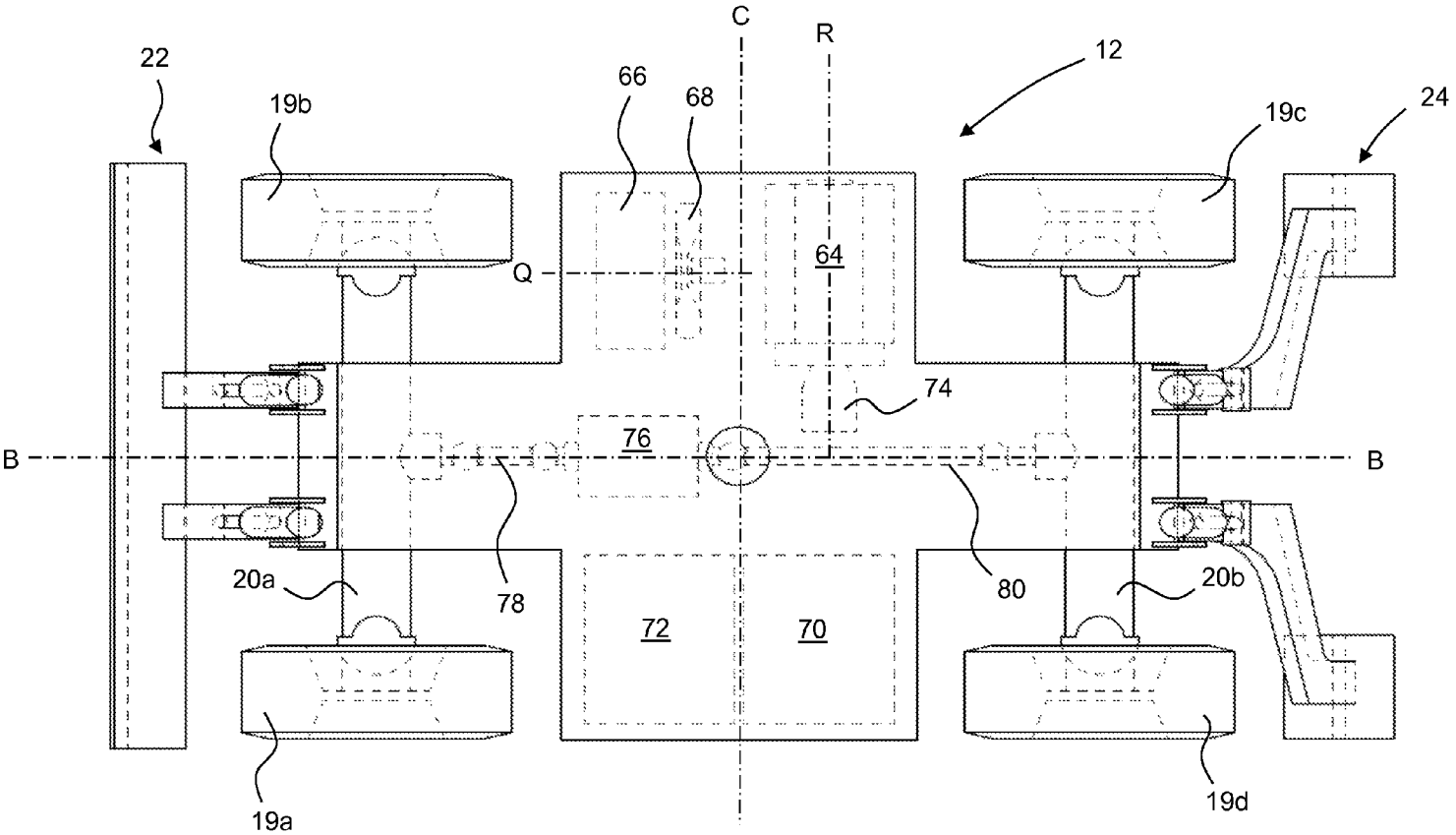
FIG. 4 is a plan view of an undercarriage portion of the machine of FIG. 1.

Referring now to FIG. 4, contrary to known excavators, the drive arrangement, including a prime mover and transmission are housed in the undercarriage 12. In the present embodiment, the prime mover is a diesel IC engine 64. The engine 64 is mounted to one side of an axis B extending centrally through the undercarriage in a fore-aft direction. The engine 64 is mounted transverse to the axis B, i.e. an axis of rotation R of a crankshaft of the engine is transverse to the axis B in the fore-aft direction. The engine 64 is further orientated such that the pistons of the engine extend in the substantially upright direction U.

A heat exchanger 66 and cooling fan 68 are housed in the undercarriage adjacent the engine 64. The cooling fan 68 is orientated such that the axis of rotation Q of the fan extends in a fore-aft direction A, although it may be oriented differently in other embodiments.

A fuel tank 70 providing a fuel supply to the engine 64 is positioned on an opposite side of the axis B to the engine. A hydraulic tank 72 is provided adjacent the fuel tank 70 on an opposite side of the axis B to the engine.

The engine 64, heat exchanger 66, cooling fan 68, fuel tank 70 and hydraulic tank 72 are all housed in a region between the axles 20*a* and 20*b*. As can be seen in FIG. 1, the engine 64 is positioned below a level coincident with a lower extent of the superstructure 14. Indeed the majority of the engine 64, and in this embodiment the entire engine 64 is positioned below a level Q coincident with an upper extent of the wheels 19*a*, 19*b*, 19*c*, 19*d*. In the present embodiment the majority of the heat exchanger 66, cooling fan 68, fuel tank 70 and hydraulic tank 72 are below a level Q coincident with the upper extent of the wheels 19*a*, 19*b*, 19*c*, 19*d*.

In the present embodiment the transmission is a hydrostatic transmission, but in alternative embodiments the transmission may be mechanical or electrical. The transmission includes a hydraulic pump 74 and a hydraulic motor 76. The engine 64 is configured to drive the pump 74, and the pump 74 is configured to supply hydraulic fluid from the hydraulic fluid tank 72 to the hydraulic motor 76. The hydraulic motor 76 rotates two drive shafts 78, 80 that rotate the axles 20*a*, 20*b* to propel the working machine 10 along the ground, i.e. in the present embodiment the working machine is four wheel drive. In alternative embodiments the working machine may be two wheel drive or may be configured to permit an operator to select two or four wheel drive.

The pump 74 is positioned adjacent the engine 64 and is orientated such that an input to the pump from the engine is axially aligned with an output from the engine to the pump. The hydraulic motor 76 is positioned such that an axis of rotation of the hydraulic motor is coincident with the axis B. In the present embodiment the hydraulic motor 76 is positioned to one side of an axis C extending centrally through the undercarriage in a lateral direction L, on an opposite side of the axis C to the hydraulic pump 74 and engine. That is, in the present embodiment, the hydraulic motor 76 is positioned towards the dozer blade arrangement 22, and the engine and hydraulic pump are positioned towards the stabilizer arrangement 24.

The hydraulic pump 74 further supplies hydraulic fluid to the hydraulic cylinders 50, 52, 54, 60, 62 for operating the working arm arrangement (discussed below) and hydraulic cylinders 21, 23 of the dozer blade and stabilizer arrangement, and a suitable control valve arrangement is configured to control supply to the hydraulic cylinders. However, in alternative embodiments individual pumps may be used for supplying hydraulic fluid to the motors and the hydraulic cylinders for one or more of the hydraulic cylinders.

Superstructure

The superstructure 14 comprises a structural platform 26 mounted on the slewing ring 16. As can be seen in the Figures, the slew ring 16 is substantially central to the undercarriage 12 in a fore-aft direction A and a lateral direction L, so as to mount the superstructure 14 central to the undercarriage. The slew ring 16 permits rotation of the superstructure 14 relative to the undercarriage about a generally upright axis Z.

A rotary joint arrangement 85 is provided central to the slew ring 16 and is configured to provide multiple hydraulic fluid lines, a return hydraulic fluid line, and an electrical—Controller Area Network (CAN)—signal line to the superstructure from the undercarriage, whilst permitting a full 360° rotation of the superstructure relative to the undercarriage. The configuration of such a rotary joint arrangement is known in the art.

The platform 26 mounts a cab 30. The cab houses the operator's seat and machine controls. The cab is mounted to the platform via a rotary arrangement 32 that connects electrical cable(s) and/or hydraulic hose(s) (not shown) between the superstructure 14 and the cab. A slack is provided in the cables and/or hydraulic hoses to permit the cables/hoses to be wound or unwound to allow for rotation of the cab relative to the superstructure about a generally upright axis Y. Rotation of the cab 30 relative to the superstructure 14 is limited to 270° in this embodiment, but may be in a range of 180° to 360°. Limiting rotation to less than 360° permits a simplified arrangement to be used to route cables and/or hoses to the cab. Alternatively, the rotary arrangement could be arranged to permit a full 360° of rotation, e.g. using a rotary joint arrangement similar to that between the undercarriage and the superstructure.

The superstructure 14 is rotated relative to the undercarriage 12 using a first hydraulic motor 32. The cab 30 is rotated relative to the superstructure 14 using a second hydraulic motor (not visible in the drawings) which is situated under the operator's seat. In alternative embodiments the superstructure and/or cab may be rotated using an electric motor.

In this embodiment axes Y and Z are offset, but in other embodiments may be coincident.

The platform further mounts a kingpost 28 for a working arm arrangement 40. The kingpost 28 arrangement is known in the art, and permits rotation of the working arm about a generally upright axis X and about a generally lateral axis W.

The superstructure 14 further comprises a counterweight 34 for the working arm arrangement positioned at an opposite side of the superstructure to the kingpost 28.

In the straight dig position shown in FIGS. 1 to 3, the counterweight 34 is behind the cab 30 to optimize the counterbalance effect, and in the roading position shown in FIGS. 8 to 11 the counterweight 34 is in front of the cab 30.

In this embodiment, the counterweight 34 has a curved profile in a region nearest the cab. The rear 36 of the cab and the front 38 of the cab each have a curved profile that is complimentary to the curved profile of the counterweight. The complimentary curved profiles accommodate rotation of the cab relative to the superstructure 14 in a particularly compact manner. The counterweight protrudes upwardly from the platform 26 by a distance that is ¼ to ⅓ of the height of the cab 30. Such a height has been found to have limited impedance on an operator's line of sight across a range of operating modes. That is, an operator's line of sight is improved in the straight dig position shown in FIGS. 1 to 3 when looking over their shoulder and is equally good on each lateral side of the cab when the operator is facing forwards.

In this embodiment the excavator may be considered to be a compact tail swing (CTS) excavator because the counterweight extends a minimal amount beyond the footprint of the undercarriage. In other embodiments, the working machine may be configured on a zero tail swing (ZTS) excavator where the counterweight does not project beyond the footprint of the undercarriage in any position.

Working Arm

The working arm arrangement 40 of the present embodiment is an excavator arm arrangement. The working arm arrangement includes a triple articulated boom 42 pivotally connected to a dipper 44. The triple articulated boom 42 includes a first section 46 pivotally connected to a second section 48. A hydraulic cylinder 50 is provided to raise and lower the first section 46 of the boom 42 relative to the kingpost 28 about the generally lateral axis W. A further hydraulic cylinder 52 is provided to pivot the second section 48 of the boom 42 relative to the first section of the boom about a generally lateral axis T. A yet further hydraulic cylinder 54 is provided to rotate the dipper 44 relative to the boom 42 about a generally lateral axis S. A mount 56 is provided to pivotally mount an attachment to the dipper 44, in the present embodiment the attachment is a bucket 58. A hydraulic cylinder 60 is provided to rotate the attachment relative to the dipper 44. Alternative boom cylinder arrangements (e.g. twin cylinders) may however be utilized in other embodiments.

Shown most clearly in FIG. 2, a yet further hydraulic cylinder 62 is provided to rotate the working arm arrangement 40 about the generally upright axis X. Using a hydraulic cylinder arrangement to rotate the working arm arrangement simplifies manufacture and operation of the working machine 10.

Provision of a cab 30 rotatable relative to the superstructure 14, a superstructure rotatable relative to the undercarriage 12, and a working arm arrangement 40 rotatable relative to the superstructure permits said components of the working machine to be rotated relative to each other such that an operator has improved visibility compared to working machines of a similar type of the prior art and also to enable the working machine to work within a confined space.

Housing the engine in the undercarriage, as opposed to a more conventional position in the superstructure 14, improves visibility for a user. Positioning the engine in the undercarriage instead of, for example the superstructure, and positioning a majority of the engine below the level Q means that the engine does not create a barrier or at least a much lesser barrier to the line of sight of an operator. As a result the line of sight angle $\alpha$ (FIG. 1) over the right hand rear corner of the machine for an operator having a height of 185 cm (a 95th percentile male) when seated in the operator's seat is at least 30° below the horizontal, but more typically at least 40° or even up to 50° (compared to around 22° in conventional midi excavators of this size). This results in a significant reduction of the ground area around the machine that is obscured by parts of the superstructure, thereby improving visibility for maneuvering the machine. In the present embodiment, the drive arrangement has been arranged to be compactly housed within the undercarriage, which minimizes the width, length and height of the undercarriage to further improve visibility for a user.

As can be seen in the drawings, the present invention provides a compact working machine, and the position of the engine and transmission contributes to achieving said compactness. Referring to FIGS. 1 to 3, it can be seen that the superstructure 14 is approximately ¾ of the length of the undercarriage 12. However, the width of the superstructure is substantially equal to the width of the undercarriage. The cab 30 is approximately ½ of the width of the undercarriage 12, measured at the widest points, and ¾ of the length of the superstructure 14, measured at the longest points. The described dimensions of the working machine have been found to further improve visibility and also provide a versatile machine capable of operating in confined spaces.

The various advantages of the present invention will become apparent from the following description of the various operating modes of the working machine.

Straight Dig Operation

Referring to FIGS. 1 to 3, if an operator would like to perform a straight dig, the cab 30 is rotated about the upright axis Y so that an operator is facing a direction generally towards the dozer blade arrangement 22. The superstructure 14 is rotated about the upright axis Z so that the working arm arrangement 40 is only slightly offset from the axis B and so that the counterweight 34 is behind the cab and the operator can see down the side of the working arm into e.g. a trench being excavated. The hydraulic cylinder 62 is then extended or retracted, as required, to rotate the working arm arrangement about the upright axis X such that the working arm is substantially parallel to the axis B. In this position, an operator is seated facing towards the working arm arrangement 40 and has good visibility of the region that requires excavating. Additionally, if the operation is a linear trenching operation the working machine can simply be repositioned by reversing once a portion of the trench is excavated.

The stabilizer arrangement 24 can be deployed to engage the ground for added stability. If further stability is required, the dozer blade arrangement 22 can be extended to engage the ground and lift the wheels 19*a*, 19*b* of the front axle 20*a* off the ground.

The hydraulic cylinders 52, 54, 60 can then be used to pivot the first and second sections of the boom 42 relative to each other, pivot the dipper 44 relative to the boom 42, and/or pivot the bucket 58 relative to the dipper, as required to perform an excavating operation.

As can be seen in FIG. 1, the configuration of the working machine 10 enables an operator to have good visibility of the area being excavated.

Offset Dig Operation

Figure 5:
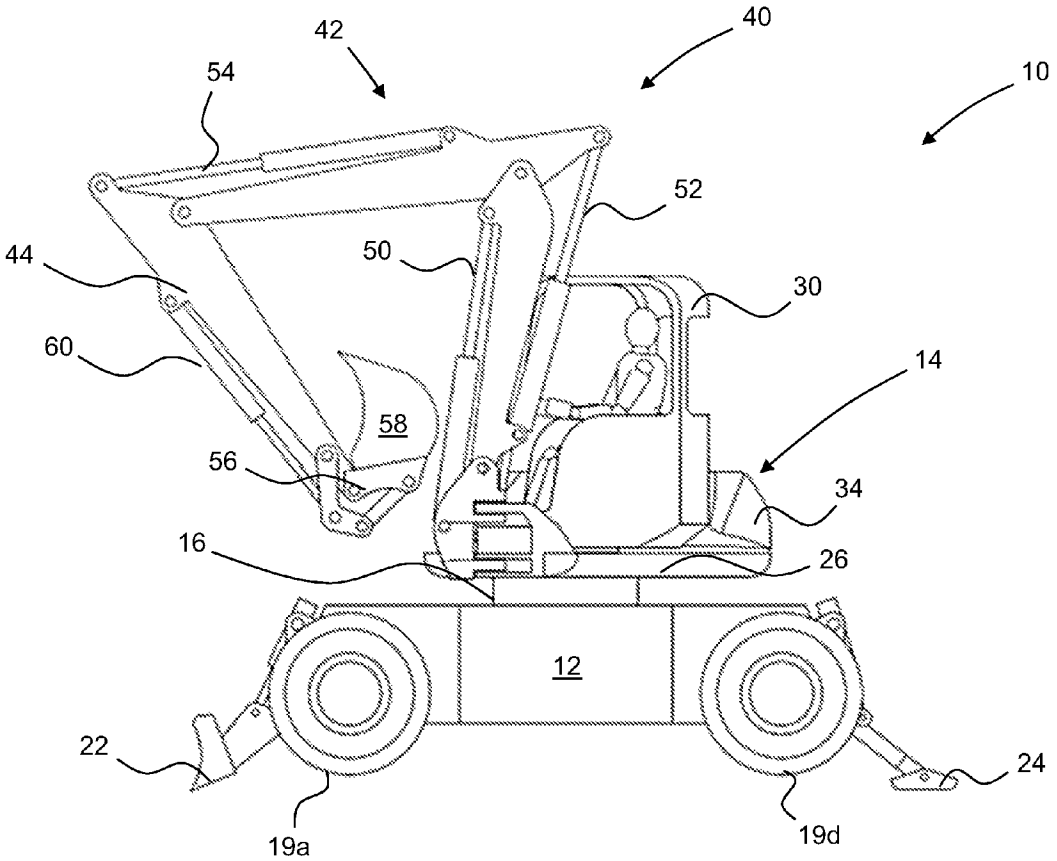
FIG. 5 is a side view of the machine of FIG. 1 in an offset dig position.
Figure 6:
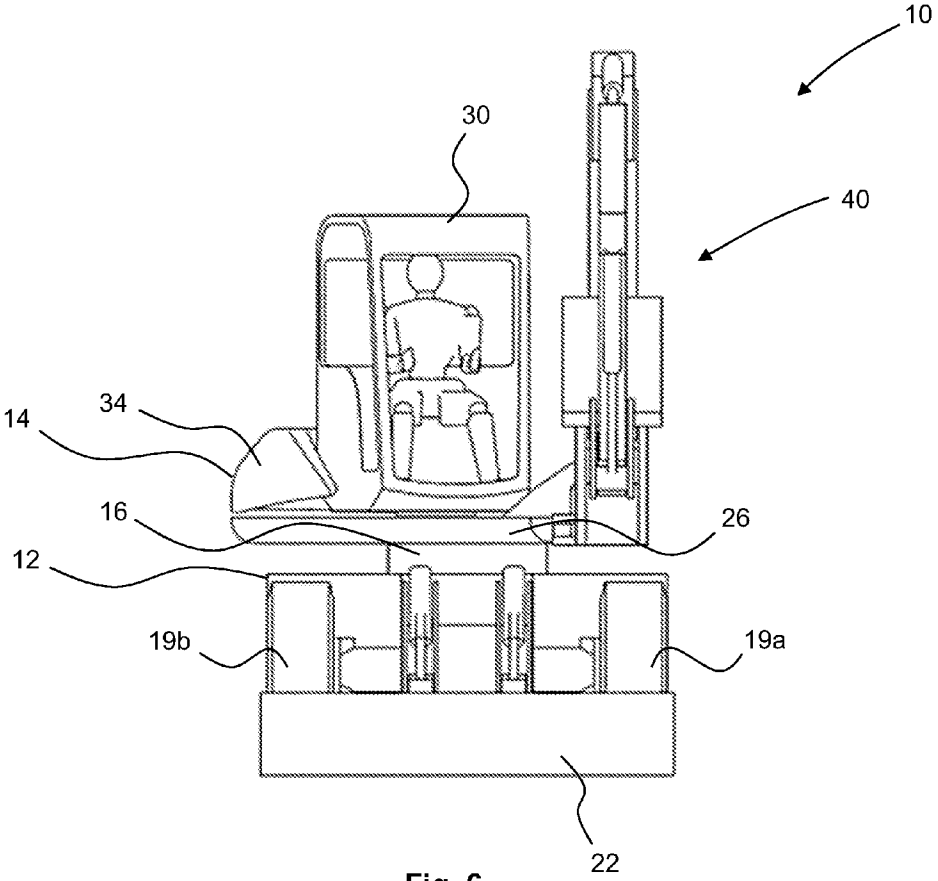
FIG. 6 is a front view of the machine of FIG. 5.
Figure 7:
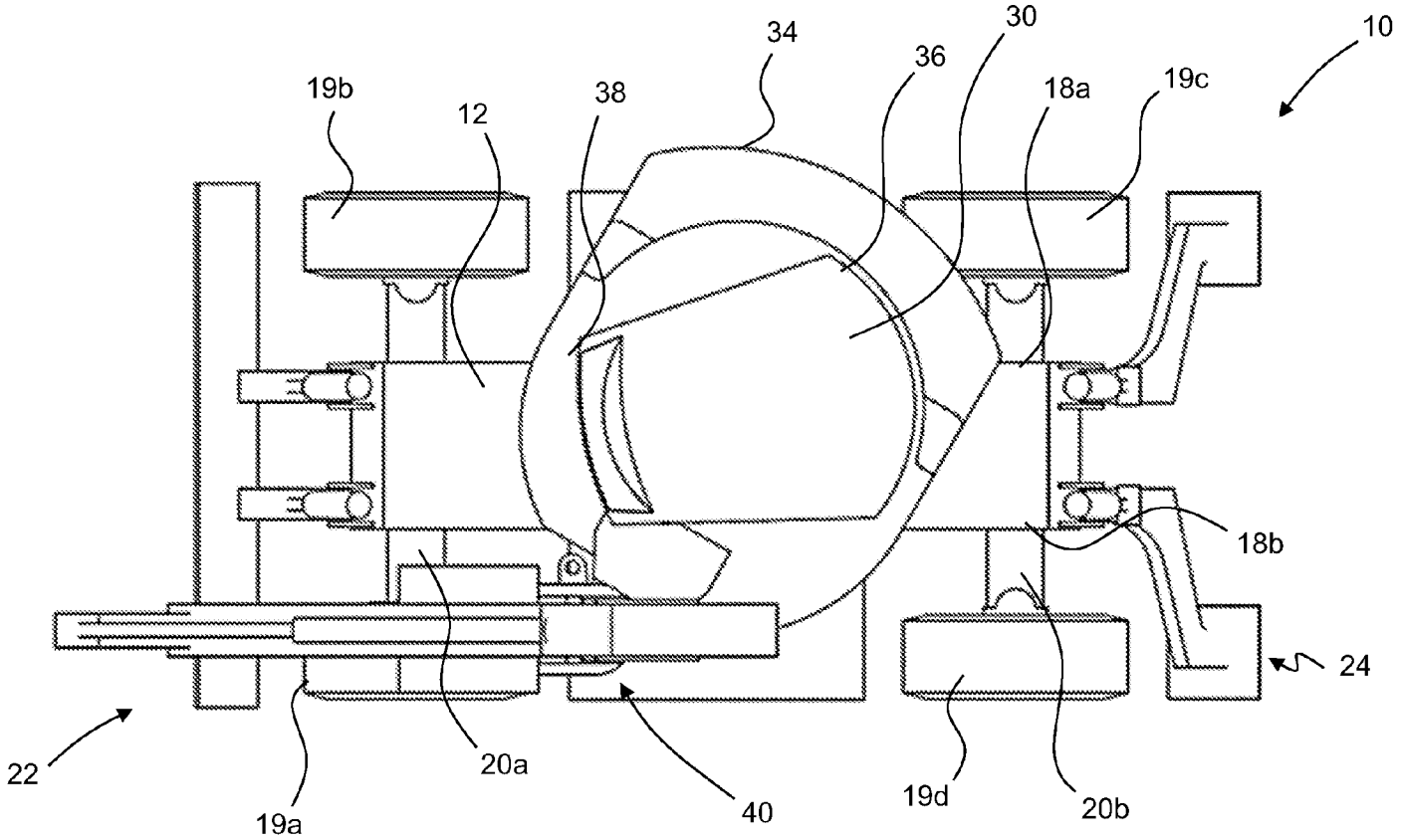
FIG. 7 is a plan view of the machine of FIG. 5.
Figure 8:
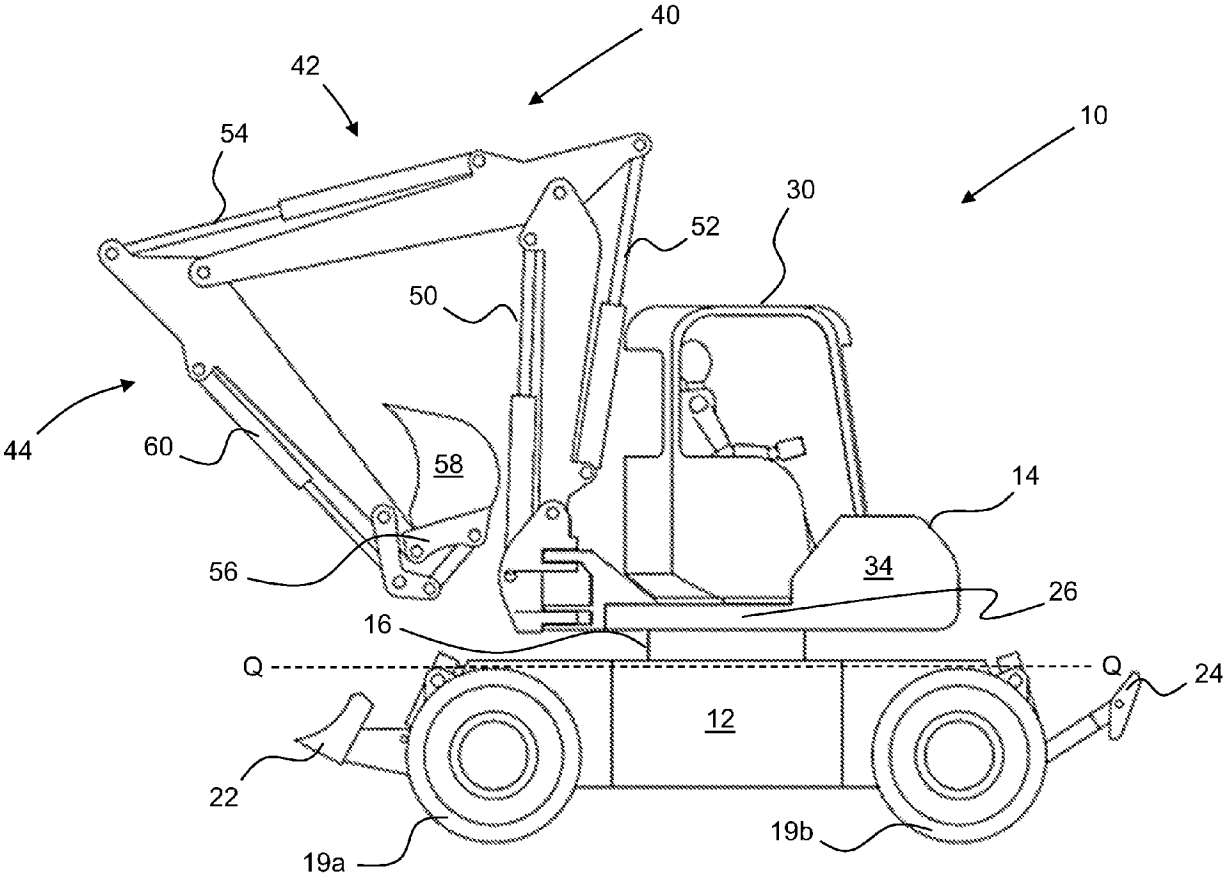
FIG. 8 is a side view of the working machine of FIG. 1 in a roading position.
Figure 9:
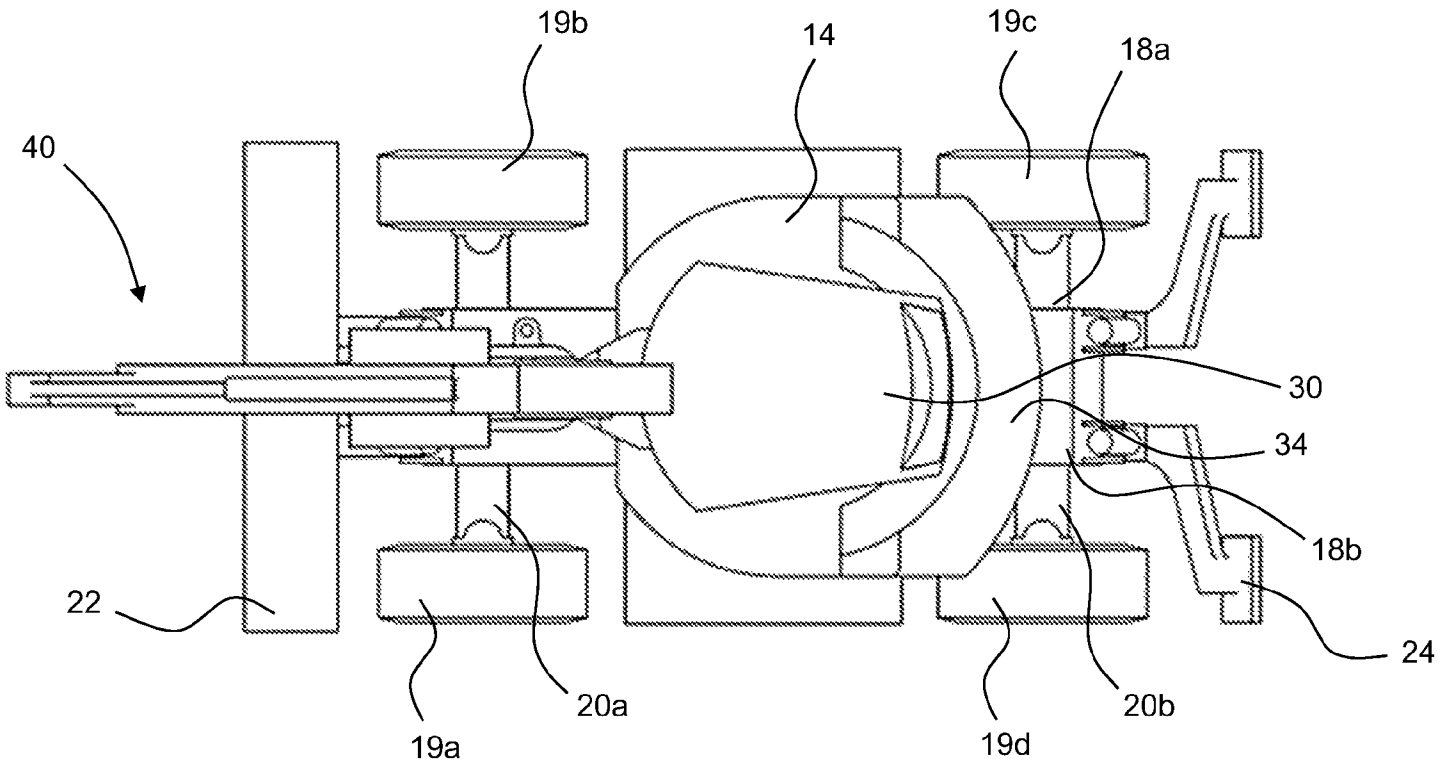
FIG. 9 is a plan view of the machine of FIG. 8.
Figure 10:
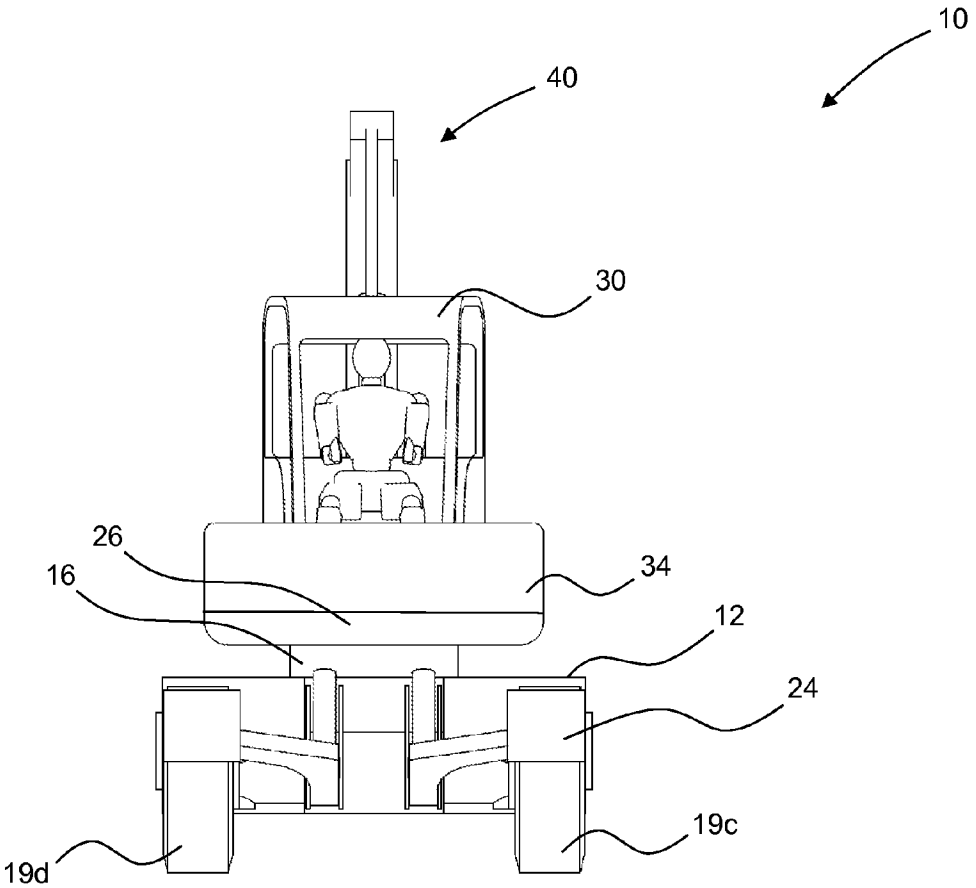
FIG. 10 is a front view of the machine of FIG. 8.
Figure 11:
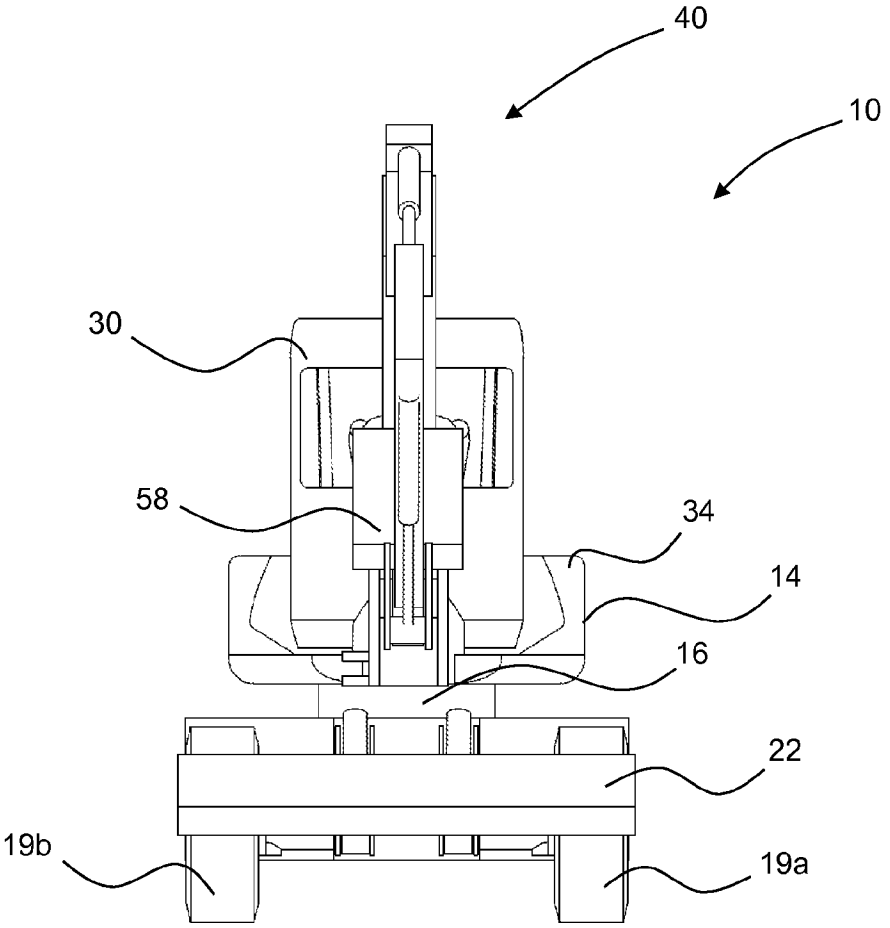
FIG. 11 is a rear view of the machine of FIG. 8.

Referring to FIGS. 5 to 7, an offset mode of excavating is shown. This type of excavating may be used, for example, if the working machine 10 is being used to dig a trench near a wall. In this mode of operation the cab 30 can be rotated so as to be facing towards an end where the dozer blade 22 is positioned, but transverse to the axis B so that the operator is facing towards the trench to be dug. The superstructure is rotated so that the counterweight 34 is rearward of the cab 30 but offset to one side and the working arm arrangement 40 is forward of the cab 30 but offset to one side thereof.

The hydraulic cylinder 62 is then retracted to rotate the working arm arrangement 40 so as to extend in the fore-aft direction. If required, the stabilizer arrangement 24 and optionally the dozer arrangement 22 are extended for additional stability. The hydraulic cylinders 50, 52, 54 and 60 are then operated to move the working arm arrangement 40 to dig the trench. Further, repositioning after a digging operation may be achieved by simple reversing of the working machine.

Roadinq Operation

Referring to FIGS. 8 to 11, if an operator wants to drive the working machine 10, for example on the road, for a significant distance (i.e. a "roading" operation) the cab 30 is rotated so that an operator is facing a direction generally towards the stabilizer arrangement 24. The superstructure 14 is rotated so that the counterweight 34 is at the front of the cab and the working arm arrangement 40 is to the rear of the cab.

The hydraulic cylinders 50, 52, 54 and 60 are extended to fold the working arm arrangement 40 into a compact configuration.

Positioning the working arm arrangement 40 behind the cab 30, the small height of the counterweight 34 and the position of the engine within the undercarriage ensures that the operator's vision during driving is optimized.

As is evidenced from the described modes of operation, the working machine of the present invention enables an operator to perform numerous different operating tasks in a confined space and with improved visibility.

Variants

Although the invention has been described above with reference to one or more preferred embodiments, it will be appreciated that various changes or modifications may be made without departing from the scope of the invention as defined in the appended claims.

For example, the ground engaging structure of the described working machine includes wheels, but in alternative embodiments two endless tracks may be provided.

The attachment shown connected to the working arm in the described embodiment is a bucket and the described working operation is digging, but in alternative embodiments an alternative attachment may be used and/or the working machine may be used for an alternative working operation. For example, the attachment may be a grading or ditching bucket, grapple, a waste and recycling attachment, a hydraulic breaker, or an earth drill, etc.

In the presently described embodiment the engine is positioned between the front and rear axles because this helps to provide a more compact working machine, but advantages of the invention can be achieved in alternative embodiments where for example the prime mover is an electric motor provided to directly drive each axle or each wheel.

In the presently described embodiment the engine is positioned perpendicular to the axis B so as to reduce the packaging size of the engine and transmission of the present embodiment, but advantages of the invention can be achieved in alternative embodiments where the engine may be positioned at an alternative transverse position, for example between 30 and 70° to axis B measured in a clockwise direction.

In the presently described embodiment the engine is positioned such that a longitudinal axis of the pistons is orientated substantially upright, but in alternative embodiments the pistons may be alternatively orientated, for example the pistons may be substantially horizontal. In further alternative embodiments, the prime mover may not be a diesel engine, for example the engine may be a petrol engine, further alternatively the prime mover may not be a reciprocating engine, for example the engine may be an electric motor powered by one or more batteries or a fuel cell.

The arrangement of the fuel tank, hydraulic fluid tank, heat exchanger, fan and engine of the present invention is advantageous because of its compact nature, but advantages of the invention can be achieved in alternative embodiments where these components may be positioned in alternative locations, for example the fuel tank and hydraulic fluid tank may not be positioned between the axles.

The cab of the presently described embodiment is positioned substantially centrally to the superstructure which means that an operator's line of sight is similar on both lateral sides of the working machine, but in alternative embodiments the cab may be offset from the center of the superstructure. The cab and superstructure of the present invention are dimensioned such that the cab stays within a region defined by the superstructure in all modes of operation, but in alternative embodiments a portion of the cab may overhang the superstructure in certain modes of operation.

In the described embodiment, the superstructure 14 is mounted at a central position of the undercarriage 12 which has been found to be optimal for improved visibility and compactness of the working machine, but advantages of the invention can be achieved in alternative embodiments where the superstructure may be mounted at any suitable position on the undercarriage.

The counterweight of the presently described embodiment is curved to accommodate the cab, but in alternative embodiments the counterweight may be sufficiently spaced from the cab to permit rotation of the cab and/or the counterweight may be provided as a discrete plurality of weights.

The working arm of the present embodiment is a king post arrangement, but in alternative embodiments the working arm arrangement may be pivotally mounted to the superstructure in any other known way.

The working arm described includes a dipper and a triple articulated boom, but in alternative embodiments the boom may only be articulated at the connection to the superstructure and the dipper. In further alternative embodiments a section of the boom or the dipper may be telescopic.

In other embodiments, an alternative transmission arrangement may be used, such as a conventional gearbox, powershift gearbox and/or torque converter gearbox. An alternative prime mover may also be used instead of or in conjunction with an IC engine, for example an electric motor.

The working machine may be operated using manual, hydraulic or electro-hydraulic controls.

The relative dimensions of the cab, superstructure and undercarriage of the present invention have been optimized to further improve the line of sight of an operator, but advantages of the invention can be achieved in alternative embodiments where any suitable relative dimensions may be selected.

In the present embodiment, the wheels on both axles are steerable (i.e. the working machine is configured for four wheel steer), but in alternative embodiments only the wheels on one of the axles may be steerable (i.e. the working machine is configured for two wheel steer).

In the present embodiment, the cab is shown in the figures is a fully enclosed structure with a cab door, but in alternative embodiments the cab may be an open structure having a roof and accommodating the control panel and operator seat.

The invention claimed is:

1. A working machine comprising:

a ground engaging structure;

an undercarriage connected to the ground engaging structure;

a slew ring;

a superstructure rotatably mounted to the undercarriage and operatively coupled to the undercarriage via the slew ring so as to be rotatable relative to the undercarriage about a first generally upright axis;

an operator's cab rotatably mounted on the superstructure so as to be rotatable relative to the superstructure about a second generally upright axis;

a working arm rotatably mounted to the superstructure so as to be moveable up and down about a generally horizontal axis; and a drive arrangement for moving the ground engaging structure to propel the working machine, the drive arrangement including a prime mover and transmission; and wherein the prime mover and transmission are housed within the undercarriage, and the entire prime mover is positioned below a level coincident with the slew ring.

2. The working machine according to claim 1, wherein the working arm is rotatably mounted to the superstructure so as to be rotatable relative to the superstructure about a third generally upright axis.

3. The working machine according to claim 1, wherein the ground engaging structure includes a front and rear axle each having a pair of wheels mounted thereto, and wherein a majority of the prime mover is positioned below a level coincident with an upper extent of the wheels.

4. The working machine according to claim 1, wherein the prime mover is mounted in a transverse direction to a fore-aft direction of the working machine.

5. The working machine according to claim 4, wherein the prime mover is mounted substantially perpendicular to the fore-aft direction of the working machine.

6. The working machine according to claim 1, wherein the prime mover is a reciprocating engine having an upright orientation.

7. The working machine according to claim 1, wherein a heat exchanger and cooling fan are mounted adjacent the prime mover and arranged such that an axis of rotation of the fan is substantially parallel to a fore-aft direction of the working machine.

8. The working machine according to claim 1, wherein the working machine comprises a fuel tank positioned on one side of an axis extending in the fore-aft direction of the working machine and the prime mover is positioned on the other side of an axis extending in the fore-aft direction of the working machine.

9. The working machine according to claim 1, wherein the working machine comprises a hydraulic fluid tank positioned on one side of an axis extending in a fore-aft direction of the working machine and the engine is positioned on the other side of the axis extending in the fore-aft direction of the working machine.

10. The working machine according to claim 1, wherein the cab is positioned substantially centrally to the superstructure.

11. The working machine according to claim 1, wherein the second upright axis about which the superstructure is rotated is substantially central to the undercarriage.

12. The working machine according to claim 1, wherein a counter weight is mounted to the superstructure in a position opposite the working arm.

13. The working machine according to claim 12, wherein the counter weight is curved and a portion of the cab is curved, and wherein the curve of the counter weight follows the curve of the cab.

14. The working machine according to claim 1, wherein the superstructure is dimensioned to be longer in length than width, the length and width being defined such that when the working machine is driving along a road the length of the superstructure is in a fore-aft direction.

15. The working machine according to claim 14, wherein the working arm is mounted to the superstructure at a position that is at one end of the superstructure in a length direction and central to the superstructure in a width direction.

16. The working machine according to claim 1, wherein the superstructure can rotate relative to the undercarriage by at least 180°.

17. The working machine according to claim 1, wherein the cab can rotate relative to the superstructure by at least 180°.

18. The working machine according to claim 1, wherein the working machine is arranged to be a compact tail swing excavator.

19. The working machine according to claim 1, wherein the axis of rotation of the cab with respect to the superstructure is coincident with the axis of rotation of the superstructure with respect to the undercarriage.

20. A working machine comprising:

a ground engaging structure;

an undercarriage connected to the ground engaging structure;

a superstructure rotatably mounted to the undercarriage so as to be rotatable relative to the undercarriage about a first generally upright axis;

an operator's cab rotatably mounted on the superstructure so as to be rotatable relative to the superstructure about a second generally upright axis;

a working arm rotatably mounted to the superstructure so as to be moveable up and down about a generally horizontal axis; and a drive arrangement for moving the ground engaging structure to propel the working machine, the drive arrangement including a prime mover and transmission; and wherein the prime mover and transmission are housed within the undercarriage, and the entire prime mover is positioned below a level coincident with a lowest extent of the superstructure.

* * * * *